US005095708A

United States Patent [19]

Kalina

[11] Patent Number: 5,095,708

[45] Date of Patent: Mar. 17, 1992

[54] METHOD AND APPARATUS FOR CONVERTING THERMAL ENERGY INTO ELECTRIC POWER

[76] Inventor: Alexander I. Kalina, 105 Glen Garry Way, Hillsborough, Calif. 94010

[21] Appl. No.: 677,650

[22] Filed: Mar. 28, 1991

[51] Int. Cl.[5] ..... F01K 25/06

[52] U.S. Cl. ..... 60/673; 60/649

[58] Field of Search ..... 60/649, 673

[56] References Cited

U.S. PATENT DOCUMENTS

| | | |
|---|---|---|
| 4,346,561 | 8/1982 | Kalina . |
| 4,489,563 | 12/1984 | Kalina . |
| 4,548,043 | 10/1985 | Kalina . |
| 4,586,340 | 5/1986 | Kalina . |
| 4,604,867 | 8/1986 | Kalina . |
| 4,732,005 | 3/1988 | Kalina . |
| 4,763,480 | 8/1988 | Kalina . |
| 4,899,545 | 2/1990 | Kalina . |
| 4,982,568 | 1/1991 | Kalina . |
| 5,029,444 | 7/1991 | Kalina . |

OTHER PUBLICATIONS

Burns & McDonnell Engineering Co. "Heber Geothermal Binary Demonstration Plant: Design, Construction, and Early Startup", EPRI, Oct. 1987.

Bliem, "Aspects of the Kalina Technology Applied to Geothermal Power Production", Idaho National Engineering Laboratory, Sep. 21, 1989.

*Primary Examiner*—Allen M. Ostrager

*Attorney, Agent, or Firm*—Arnold, White & Durkee

[57] ABSTRACT

A method and apparatus for converting thermal energy into electric power. A high pressure gaseous working stream is expanded, producing a spent stream. The spent stream is condensed, producing a condensed stream. The condensed stream forms first and second partially evaporated streams, which in turn form first and second vapor streams and first and second liquid streams. A rich stream is generated from the first vapor stream. A lean stream is generated from combining the second vapor stream with a mixing stream. The resulting rich and lean streams are passed through a boiler where they are evaporated. After exiting the boiler, the evaporated rich stream is combined with the evaporated lean stream generating the high pressure gaseous working stream, completing the cycle.

28 Claims, 2 Drawing Sheets 206
6
229
5
29
73
38
10
245
34
4
246
15
220
221
222
12
37
254
27
16
11
33
36
76
78
253
35
77
3
244
84
252
223
224
225
83
17
9
28
251
82
78
86
260
230
261
243
8
79
91
85
242
90
19
240
13
59
99
71
89
250
262
24
18
225
241
226
227
228
21
72
2
58
98
23
14
74
1
231
232
233

METHOD AND APPARATUS FOR CONVERTING THERMAL ENERGY INTO ELECTRIC POWER

BACKGROUND OF THE INVENTION

I. Field of the Invention

This invention relates generally to methods and apparatus for transforming thermal energy from a heat source into mechanical and then electrical form using a working fluid that is expanded and regenerated. This invention further relates to a method and system for improving the thermal efficiency of a thermodynamic cycle via the generating of at least two multi-component liquid working streams, including a rich stream and a lean stream. The rich stream includes a higher percentage of a low-boiling component than is included in the lean stream.

II. Brief Description of the Background Art

U.S. Pat. No. 4,548,043 describes a system that uses two different streams of working solution with different compositions. That system includes means for heating and expanding a working fluid and a condensation subsystem for condensing that working fluid and generating the two streams having different compositions.

The condensation subsystem described in that patent generates from a single partially evaporated stream, comprising a mixture of ammonia and water, a single enriched vapor stream and a single lean liquid stream. The enriched vapor stream is divided into two enriched vapor substreams. The lean liquid stream is divided into two lean liquid substreams. One of those enriched vapor substreams is combined with one of the lean liquid substreams producing a rich stream. The other enriched vapor substream is combined with the other lean liquid substream producing a lean stream. Because the two enriched vapor substreams are generated from a single enriched vapor stream, they are each generated at the same pressure and temperature. The two working streams generated from combining the two vapor substreams with the two liquid substreams in U.S. Pat. No. 4,548,043, i.e., the rich stream and the lean stream, are combined during the boiling process.

U.S. Pat. No. 4,604,867 likewise describes a system that includes means for evaporating and expanding a working stream followed by condensing that expanded stream via a condensation subsystem. The condensation subsystem described in that patent, like that included in U.S. Pat. No. 4,548,043, generates an enriched vapor stream and a lean liquid stream from a single partially evaporated multi-component stream. The vapor stream is combined with a portion of the liquid stream to produce the working stream that is subsequently evaporated and expanded.

The systems of U.S. Pat. Nos. 4,548,043 and 4,604,867 provide significantly enhanced thermal efficiency, when compared to conventional Rankine cycles that use a single component working fluid. However, it is always desirable to improve upon the economics and efficiencies of such systems. The method and system of the present invention, when compared to the systems described in the above-mentioned patents, provides such an improvement.

SUMMARY OF THE INVENTION

It is one feature of the present invention to provide a significant improvement in the efficiency of a thermodynamic cycle by heating and evaporating at least two multicomponent liquid working streams that comprise a rich stream and a lean stream. The rich stream includes a higher percentage of a low boiling component than is included in the lean stream. In one aspect of the present invention, the rich stream and the lean stream are combined, after they exit from the boiler, to form a high pressure gaseous working stream. This feature should allow for a better match of the required and available heat in the process of heating, vaporizing, and superheating than can be obtained if a single stream is introduced into the boiler.

In a second aspect of the present invention, the rich and lean streams are generated by forming from a condensed stream a first partially evaporated stream and a second partially evaporated stream. The first partially evaporated stream is separated into a first vapor stream and a first liquid stream, and the second partially evaporated stream is separated into a second vapor stream and a second liquid stream. The first vapor stream generates the rich stream, and the second vapor stream is combined with a mixing stream to generate the lean stream.

In accordance with one embodiment of the present invention, a method for implementing a thermodynamic cycle includes the step of expanding a high pressure gaseous working stream, transforming its energy into usable form and generating a spent stream. The spent stream is then condensed, producing a condensed stream. A rich stream, having a higher percentage of a low boiling component than is included in the condensed stream, is generated from the condensed stream. A lean stream, having a lower percentage of a low boiling component than is included in the condensed stream, is also generated from the condensed stream. The rich stream and the lean stream are passed through a boiler generating an evaporated rich stream and an evaporated lean stream. The evaporated rich stream and the evaporated lean stream are then combined after the two evaporated streams exit from the boiler. This generates the high pressure gaseous working stream, completing the cycle.

In a preferred embodiment of the present invention, the rich stream and the lean stream are generated from the condensed stream by first forming from that condensed stream a first partially evaporated stream and a second partially evaporated stream. The first partially evaporated stream is separated into a first vapor stream and a first liquid stream. The second partially evaporated stream is separated into a second vapor stream and a second liquid stream. The rich stream is generated from the first vapor stream, such as by combining that first vapor stream with a first mixing stream generated from the condensed stream. Alternatively, the rich stream may be produced by condensing the first vapor stream without first combining that first vapor stream with another stream. The second vapor stream is combined with a mixing stream generating the lean stream. Preferably that mixing stream is generated from the condensed stream, but alternatively may be generated from other streams that circulate through the system, such as the first or second liquid streams, for example.

In accordance with another embodiment of the present invention, the method for implementing a thermodynamic cycle includes the step of expanding a high pressure gaseous working stream transforming its energy into usable form and generating a spent stream. The spent stream is condensed, producing a condensed stream. From the condensed stream is formed a first partially-evaporated stream and a second partially-evaporated stream. The first partially-evaporated stream is separated into a first vapor stream and a first liquid stream. The second partially-evaporated stream is separated into a second vapor stream and a second liquid stream. The first vapor stream generates a rich stream, having a higher percentage of a low boiling component than is included in the condensed stream. The second vapor stream is combined with a mixing stream, such as may be formed from the condensed stream, generating a lean stream, having a lower percentage of a low boiling component than is included in the condensed stream. The high pressure gaseous working stream is formed by combining the rich stream and the lean stream, completing the cycle.

In a preferred embodiment, the rich stream and the lean stream are combined to form the high pressure gaseous working stream after those two streams have exited from a boiler, after having been evaporated while passing through the boiler.

DESCRIPTION OF THE PREFERRED EMBODIMENTS

Figure 1:
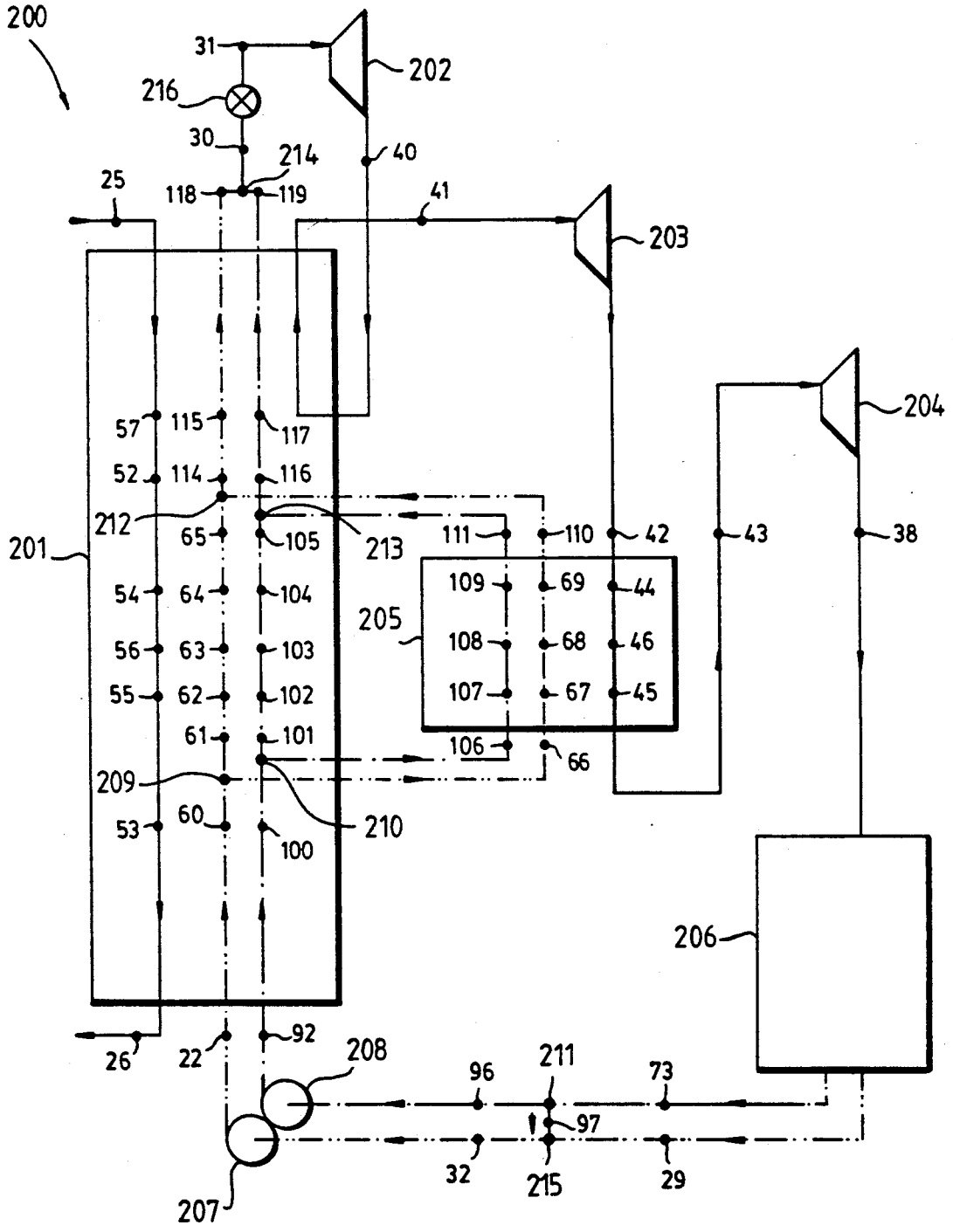
FIG. 1 is a schematic representation of one embodiment of the method and system of the present invention.

The schematic shown in FIG. 1 shows an embodiment of preferred apparatus that may be used in the method and system of the present invention. Specifically, FIG. 1 shows a system 200 that includes a boiler 201, turbines 202, 203, and 204, recooler 205, condensation subsystem 206, pumps 207 and 208, stream separators 209, 210, and 211, stream mixers 212–215, and valve 216.

Various types of heat sources may be used to drive the cycle of this invention, including for example, gas turbine exhaust gases. In this regard, the system of the present invention may be used as a bottoming cycle in combined cycle systems.

The working stream flowing through system 200 is a multi-component working stream that comprises a lower boiling point fluid—the low-boiling component—and a higher boiling point fluid—the high-boiling component. Preferred working streams include ammonia-water mixtures, mixtures of two or more hydrocarbons, two or more freons, mixtures of hydrocarbons and freons, or the like. In general, the working stream may be a mixture of any number of compounds with favorable thermodynamic characteristics and solubility. In a particularly preferred embodiment, a mixture of water and ammonia is used.

As shown in FIG. 1, a working stream circulates through system 200. The working stream includes a high pressure gaseous working stream that flows from stream mixer 214 to turbine 202. The working stream also includes a spent stream, which flows from turbine 202 to condensation subsystem 206. That spent stream includes an intermediate pressure gaseous stream, which flows from turbine 202 to turbine 203, a low pressure gaseous stream, which flows from turbine 203 to turbine 204, and a low pressure spent stream, which flows from turbine 204 to condensation subsystem 206. The working stream also includes lean and rich streams that flow from condensation subsystem 206 to stream mixer 214. The rich stream is separated into first and second rich substreams at stream separator 209, and the lean stream is separated into first and second lean substreams at stream separator 210. The second rich substream and the second lean substream pass through recooler 205 before they are recombined with the first rich substream and first lean substream to reconstitute the rich stream and lean stream at stream mixers 212 and 213, respectively.

In the embodiment shown in FIG. 1, rich and lean streams exit condensation subsystem 206 with parameters as at points 29 and 73, respectively. A portion of the lean stream is diverted at stream separator 211. That portion passes by point 97 and is combined at stream mixer 215 with the rich stream. This step of the process yields a lean stream having parameters as at point 96 and a rich stream having parameters as at point 32. This addition of a portion of the lean stream to the rich stream should help prevent the supercritical boiling of the rich stream and should help facilitate a favorable temperature-heat profile in boiler 201.

The rich and lean streams are pumped to an increased pressure at pumps 207 and 208, respectively, obtaining parameters as at points 22 and 92, respectively. The two streams are then sent into boiler 201. Both the rich and lean streams are preheated in boiler 201 obtaining parameters as at points 60 and 100, respectively. The rich stream is then separated at stream separator 209 into first and second rich substreams, and the lean stream is separated at stream separator 210 into first and second lean substreams. The first rich substream and the first lean substream, having parameters as at points 61 and 101, respectively, pass through boiler 201 where they are heated by the heating stream flowing from point 25 to point 26. Preferably, that heating stream is a stream of combustion gases emitted from a gas turbine. The second rich substream and second lean substream, with parameters as at points 66 and 106, respectively, pass through recooler 205. There, they are further heated and at least partially evaporated.

Preferably, the weight ratio of the second rich substream to the second lean substream should be about the same as the weight ratio of the first rich substream to the first lean substream and as the weight ratio of the rich stream to the lean stream, when the two streams entered boiler 201.

The second rich substream and the second lean substream exit recooler 205 with parameters as at points 110 and 111, respectively. Those substreams are preferably completely evaporated when exiting recooler 205. The second rich substream combines with the first rich substream at stream mixer 212 to reform the rich stream, having parameters as at point 114. The second lean substream combines with the first lean substream at stream mixer 213 to reform the lean stream, having parameters as at point 116.

The rich stream, having parameters at point 114, and the lean stream, having parameters at point 116, pass through boiler 201, where they are superheated via heat transferred from the stream flowing from point 25 to point 26, which is preferably a stream of combustion gases. The rich stream exits from boiler 201 with parameters as at point 118. The lean stream exits boiler 201 with parameters as at point 119. The lean stream is then combined with the rich stream at stream mixer 214, producing a high pressure gaseous working stream, having parameters as at point 30.

Because the embodiment of the present invention shown in FIG. 1 does not mix the lean stream with the rich stream during the boiling process, that embodiment eliminates potential complications that may result when such mixing takes place during the boiling process.

The stream having parameters as at point 30 passes through admission valve 216, producing a stream having parameters as at point 31. The high pressure gaseous working stream then passes through high pressure turbine 202. There it expands, producing work, and generating a spent stream. The spent stream in the embodiment shown in FIG. 1 includes an intermediate pressure gaseous stream having parameters as at point 40. That stream is returned to boiler 201 where it is reheated, producing an intermediate pressure gaseous stream having parameters as at point 41. That portion of the spent stream is then sent into intermediate pressure turbine 203. There it further expands, producing work, and producing a low pressure gaseous stream having parameters as at point 42.

The portion of the spent stream that is in the form of a low pressure gaseous stream passes through recooler 205. There, that portion of the spent stream is cooled, transferring heat for the vaporizing of the second rich substream and the second lean substream that pass from point 66 to point 110 and point 106 to point 111, respectively. The low pressure gaseous stream portion of the spent stream exits recooler 205 with parameters as at point 43. The spent stream, still in the form of a low pressure gaseous stream, is then sent into low pressure turbine 204. There, the low pressure gaseous stream portion of the spent stream is expanded, producing work, and generating a low pressure spent stream having parameters as at point 38. The spent stream, now in the form of a low pressure spent stream, then enters condensation subsystem 206.

The pressure and the temperature of the spent stream at point 43 should be chosen to enable that stream to provide additional heat for the heating and boiling of the second rich substream and the second lean substream to ensure maximum efficiency of system 200. Suggested values for the temperature and pressure for the spent stream at point 43 are shown in Table 1.

The rich and lean streams generated in condensation subsystem 206 exit condensation subsystem 206 with parameters as at points 29 and 73, respectively, completing the cycle.

The embodiment of the present invention shown in FIG. 1 includes three turbines, a single boiler, and a single recooler. The number of turbines, recoolers, and boilers may be increased or decreased without departing from the spirit and scope of the present invention. In addition, the number of rich, lean, and working streams and substreams may be increased or decreased. Likewise, additional apparatus conventionally used in thermodynamic cycle systems, e.g., reheaters, other types of heat exchange devices, separation apparatus, and the like, may be included in the embodiment shown in FIG. 1 without departing from the disclosed inventive concept.

Figure 2:
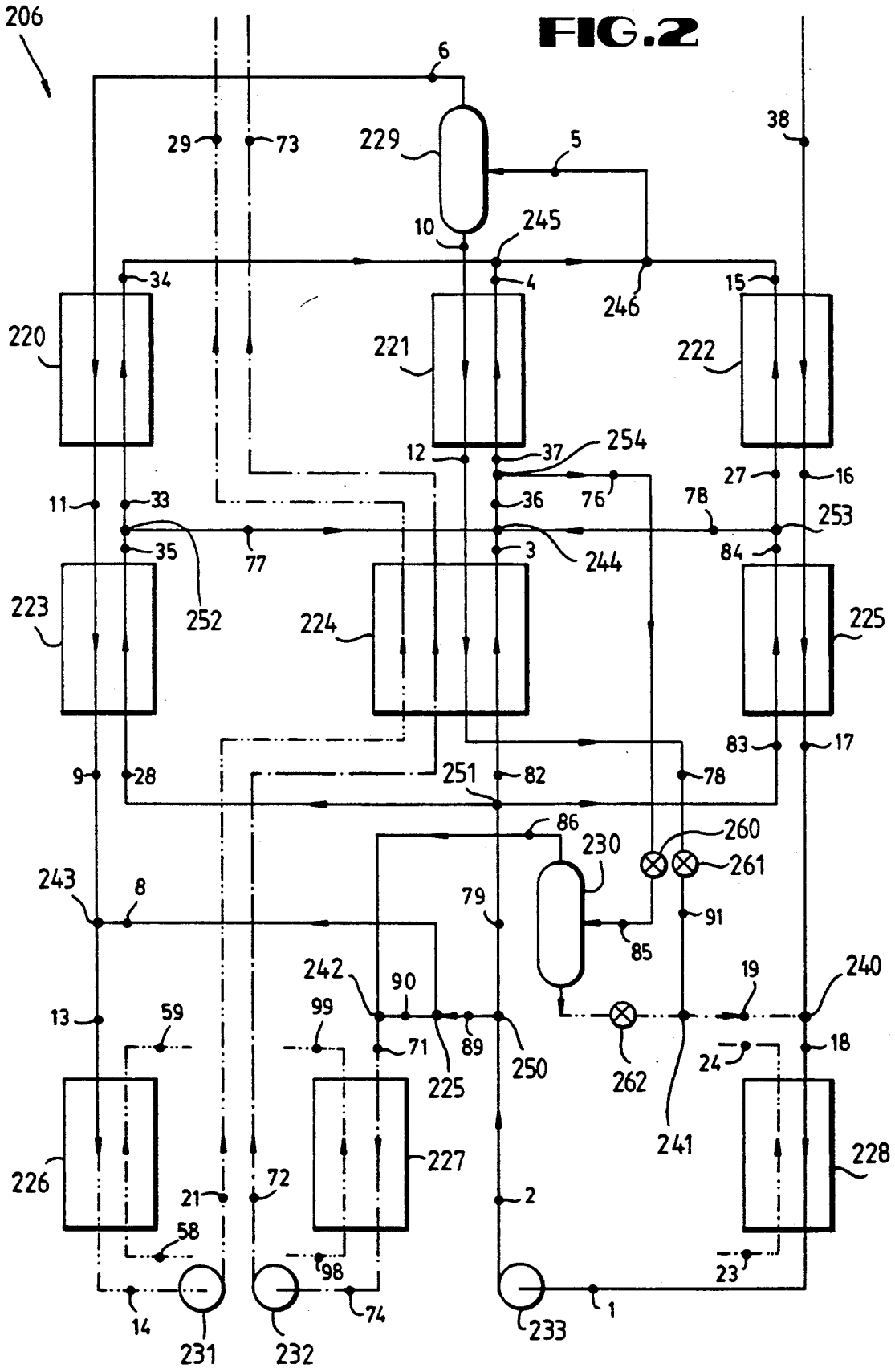
FIG. 2 is a schematic representation of an embodiment of the condensation subsystem that may be used in the present invention.

FIG. 2 shows a preferred embodiment for condensation subsystem 206. In that embodiment, the spent stream, now in the form of a low pressure spent stream, passes through heat exchangers 222 and 225, where that stream releases heat of condensation, generating a stream having parameters as at point 17. The spent stream is then mixed at stream mixer 240 with a mixed stream (hereinafter referred to as the third mixed stream). having parameters as at point 19, producing a pre-condensed stream, having parameters as at point 18. The pre-condensed stream is condensed in condenser 228, which may be cooled by a cooling stream flowing from point 23 to point 24, preferably a stream of cooling water. This produces a condensed stream having parameters as at point 1.

That condensed stream is pumped to a higher pressure by pump 233. The condensed stream, having parameters at point 2, is separated at stream separator 250 into a first condensed substream and a second condensed substream, having parameters as at points 89 and 79, respectively. The second condensed substream is separated into third, fourth, and fifth condensed substreams at stream separator 251, having parameters as at points 28, 82, and 83, respectively. Those three substreams then pass through heat exchangers 223, 224, and 225, respectively, producing first, second, and third preheated substreams, having parameters as at points 35, 3, and 84, respectively.

The first preheated substream is separated at stream separator 252 into a first prepartially evaporated substream, having parameters as at point 33, and a fourth preheated substream, having parameters as at point 77. The third preheated substream is separated at stream separator 253 into a third pre-partially evaporated substream, having parameters as at point 27, and a fifth preheated substream, having parameters as at point 78. The fourth and fifth preheated substreams are combined with the second preheated substream at steam mixer 244, producing a sixth preheated substream having parameters as at point 36. That sixth preheated substream is separated at stream separator 254 into a second prepartially evaporated substream, having parameters as at point 37, and a fourth pre-partially evaporated substream, having parameters as at point 76.

The first, second, and third pre-partially evaporated substreams pass through heat exchangers 220, 221, and 222, respectively. There, they are further heated and partially evaporated, generating a first partially evaporated substream, having parameters as at point 34, a second partially evaporated substream, having parameters as at point 4, and a third partially evaporated substream, having parameters as at point 15. The first partially evaporated substream is combined with the second partially evaporated substream at stream mixer 245. The resulting stream is then combined with the third partially evaporated substream at stream mixer 246 to produce a first partially evaporated stream, having parameters as at point 5.

That first partially evaporated stream is fed into gravity separator 229. There, the liquid is separated from the vapor, producing a first vapor stream, having parameters as at point 6, and a first liquid stream, having parameters as at point 10. The first vapor stream is enriched with a low-boiling component, when compared to the first partially evaporated stream. The first liquid stream is enriched with a high-boiling component, when compared to the first partially evaporated stream. In a preferred embodiment, that low-boiling component is ammonia and that high-boiling component is water.

The first vapor stream passes through heat exchangers 220 and 223, where it partially condenses, releasing heat that partially evaporates the first pre-partially evaporated substream passing from point 33 to point 34 and that preheats the third condensed substream passing from point 28 to point 35. The first vapor stream exits heat exchanger 223 with parameters as at point 9. The first liquid stream is cooled as it passes through heat exchangers 221 and 224, releasing heat that partially evaporates the second pre-partially evaporated substream passing from point 37 to point 4 and that preheats the fourth condensed substream passing from point 82 to point 3, the rich stream passing from point 21 to point 29, and the lean stream passing from point 72 to point 73. The first liquid stream exits heat exchanger 224 with parameters as at point 70. The heat released by the spent stream, as it passes through heat exchangers 222 and 225, is used to preheat the fifth condensed substream passing from point 83 to point 84, and to partially evaporate the third pre-partially evaporated substream passing from point 27 to point 15.

The first condensed substream, having parameters as at point 89, is separated at stream separator 255 into a first mixing stream, having parameters as at point 8, and a second mixing stream, having parameters as at point 90. The first mixing stream is combined with the first vapor stream at stream mixer 243 to produce the rich stream having parameters as at point 13. At sufficiently high pressure, the first vapor stream flowing past point 9 may become the rich stream flowing past point 13 without mixing with a first mixing stream like that flowing past point 8. In such a case, the first condensed substream is not separated into first and second mixing streams at stream separator 255. Instead, all of the first condensed substream flowing past point 89 continues on to point 90 without any of that stream being diverted at stream separator 255 to form the first mixing stream.

The fourth pre-partially evaporated substream, having parameters as at point 76, is throttled to a lower pressure at valve 260, producing a second partially evaporated stream having parameters as at point 85. The pressure of the second partially evaporated stream at point 85 preferably is lower than the pressure of the first vapor stream at point 9 or the pressure of the rich stream at point 14. The pressure of the second partially evaporated stream at point 85 is preferably higher than the pressure of the condensed stream at point 1.

The second partially evaporated stream is sent into gravity separator 230 where the liquid is separated from the vapor. A second vapor stream, with parameters as at point 86, exits from the top of gravity separator 230. That second vapor stream is enriched with a low-boiling component, which is ammonia in an ammonia-water mixture. A second liquid stream, with parameters as at point 87, exits from the bottom of gravity separator 230. That second liquid stream is enriched with a high-boiling component, which is water in an ammonia-water mixture. The second vapor stream is combined with the second mixing stream at stream mixer 242, generating the lean stream.

The lean stream generated at stream mixer 242 is fully condensed in condenser 227 by a cooling stream flowing from point 98 to point 99, preferably a stream of cooling water. The lean stream exits condenser 227 with parameters as at point 74. The rich stream is fully condensed in condenser 226 by heat exchange with a cooling stream flowing from point 58 to point 59, preferably a stream of cooling water. The rich stream exits from condenser 226 with parameters as at point 14. The flow rate of the rich stream at point 14 is lower than the flow rate of the spent stream at point 38, and the percentage of the low-boiling component in the rich stream at point 14 is higher than the percentage of that component included in the spent stream at point 38.

The first liquid stream has its pressure reduced when passing through valve 261, obtaining parameters as at point 91. The second liquid stream has its pressure reduced as it passes through throttle valve 262, obtaining parameters as at point 20. (The second liquid stream at point 20 may be in the form of a partially evaporated stream.) The first liquid stream is combined with the second liquid stream at stream mixer 241, generating the third mixing stream having parameters as at point 19. As described above, that third mixing stream is mixed with the spent stream at stream mixer 240, generating the pre-condensed stream having parameters as at point 18.

The rich stream is pumped to an intermediate pressure by pump 231, producing a rich stream having the parameters as at point 21. The lean stream is pumped to an intermediate pressure by pump 232, producing a lean stream having parameters as at point 72. The rich stream and the lean stream are then fed into heat exchanger 224, where they are heated with heat transferred from the first liquid stream passing from point 12 to point 70. The rich stream exits heat exchanger 224 with parameters as at point 29. The lean stream exits heat exchanger 224 with parameters as at point 73. The lean stream and the rich stream then exit condensation subsystem 206, as shown in FIG. 1.

The sum of the flow rates for the rich stream at point 29 and the lean stream at point 73 is equal to the flow rate for the spent stream at point 38. If the rich stream were mixed with the lean stream, the composition of the resulting mixture would be identical to the composition of the spent stream at point 38. However, via condensation subsystem 206, two streams of working solution have been created: a rich stream, having parameters as at point 29, which includes a higher percentage of a low-boiling component than is included in the spent stream at point 38, and a lean stream, having parameters as at point 73, which includes a lesser amount of a low-boiling component than is included in the spent stream at point 38.

In the embodiment of the condensation subsystem shown in FIG. 2, the condensation subsystem produces a rich stream from a first vapor stream that is at a different pressure and temperature from the second vapor stream used to produce the lean stream. Such a technique should provide for better use of the available heat over a wider range of temperatures than could be achieved if the vapor streams used to produce the rich stream and the lean stream were each maintained at the same pressure and temperature. The condensation subsystem shown in FIG. 2 thus should permit the pressure of the spent stream at point 38 to be lower than necessary to reproduce a single stream of working solution. If the two vapor streams, used to generate the rich stream and the lean stream, were maintained at the same pressure and temperature, the pressure of the spent stream at point 38 may have to have been higher than necessary to reproduce a single stream of working solution. The condensation subsystem of FIG. 2 thus should be more efficient than a condensation subsystem that generates a rich stream and a lean stream from first and second vapor streams that were maintained at the same pressure and temperature.

The condensation subsystem shown in FIG. 2 may be used in conjunction with systems other than that shown in FIG. 1. For example, that condensation subsystem may be used in a system which includes the step of preheating the rich stream and the lean stream producing a preheated rich stream and a preheated lean stream, followed by combining the preheated rich stream with the preheated lean stream producing a preheated stream, followed by evaporating the preheated stream producing a high pressure gaseous working stream. Alternatively, that condensation subsystem may be used in a system which includes the step of preheating and partially evaporating the rich stream and the lean stream producing a partially evaporated rich stream and a partially evaporated lean stream, followed by combining the partially evaporated rich stream with the partially evaporated lean stream forming a partially evaporated stream, followed by evaporating the partially evaporated stream producing the high pressure gaseous working stream. Alternatively, that condensation subsystem may be used in a system which includes the steps of preheating and evaporating the rich stream and the lean stream producing an evaporated rich stream and an evaporated lean stream, followed by combining the evaporated rich stream with the evaporated lean stream forming an evaporated stream, followed by superheating the evaporated stream producing the high pressure gaseous working stream.

The embodiment of the condensation subsystem shown in FIG. 2 may be varied in numerous ways without departing from the spirit and scope of the present invention. In that regard, the number and type of heat exchangers, condensers, separation apparatus, valves, and pumps may be varied. The number and type of streams flowing through the embodiment of the condensation subsystem shown in FIG. 2 may be varied. Similarly, the applications for any such streams may be modified. Likewise, additional apparatus conventionally used in thermodynamic cycle systems may be included in that condensation subsystem without departing from the spirit and scope of the present invention.

Suggested parameters for the points corresponding to the points set forth in system 200 shown in FIG. 1 are presented in Table 1 for a system having a water-ammonia rich stream that exits condensation subsystem 206 with a composition which includes 95.51 weight % of ammonia, and a water-ammonia lean stream that exits condensation subsystem 206 with a composition which includes 59.16 weight % of ammonia. Suggested parameters for the points corresponding to the points set forth in condensation subsystem 206 shown in FIG. 2 are presented in Table 2 for a system having a water-ammonia working stream. A summary of the performance of the system shown in FIGS. 1 and 2, using the parameters shown in Tables 1 and 2, is included in Table 3.

TABLE 1

| Point | P(psiA) | X | T °F. | H(BTU/lb) | G/G30 | Flow lb/hr |
|---|---|---|---|---|---|---|
| 22 | 2734.00 | .8709 | 140.79 | 93.85 | .5672 | 415,052 |
| 25 | . | Gas | 971.60 | 245.21 | 5.3795 | 3,936,508 |
| 26 | . | Gas | 172.01 | 35.12 | 5.3795 | 3,936,508 |
| 29 | 431.87 | .9551 | 131.00 | 98.53 | .4358 | 318,899 |
| 30 | 2507.00 | .7500 | 930.68 | 1175.63 | 1.0000 | 731,757 |
| 31 | 2322.00 | .7500 | 927.60 | 1175.63 | 1.0000 | 731,757 |
| 32 | 332.21 | .8709 | 138.85 | 79.65 | .5672 | 415,052 |
| 38 | 34.37 | .7500 | 188.00 | 738.50 | 1.0000 | 731,757 |
| 40 | 650.00 | .7500 | 674.61 | 1022.00 | 1.0000 | 731,757 |
| 41 | 625.00 | .7500 | 927.60 | 1191.88 | 1.0000 | 731,757 |
| 42 | 115.52 | .7500 | 584.14 | 977.95 | 1.0000 | 731,757 |
| 43 | 113.52 | .7500 | 325.00 | 822.95 | 1.0000 | 731,757 |
| 44 | 115.22 | .7500 | 449.48 | 896.33 | 1.0000 | 731,757 |
| 45 | 114.52 | .7500 | 385.53 | 858.38 | 1.0000 | 731,757 |
| 46 | 115.02 | .7500 | 418.26 | 877.72 | 1.0000 | 731,757 |
| 52 | . | Gas | 584.14 | 141.06 | 5.3795 | 3,936,508 |
| 53 | . | Gas | 325.56 | 74.10 | 5.3795 | 3,936,508 |
| 54 | . | Gas | 448.83 | 105.80 | 5.3795 | 3,936,508 |
| 55 | . | Gas | 385.26 | 89.40 | 5.3795 | 3,936,508 |
| 56 | . | Gas | 417.72 | 97.76 | 5.3795 | 3,936,508 |
| 57 | . | Gas | 702.56 | 172.36 | 5.3795 | 3,936,508 |
| 60 | 2689.00 | .8709 | 307.00 | 310.08 | .5672 | 415,052 |

TABLE 1-continued

| Point | P(psiA) | X | T °F. | H(BTU/lb) | G/G30 | Flow lb/hr |
|---|---|---|---|---|---|---|
| 61 | 2689.00 | .8709 | 307.00 | 310.08 | .3960 | 289,746 |
| 62 | 2657.00 | .8709 | 367.19 | 454.80 | .3960 | 289,746 |
| 63 | 2642.00 | .8709 | 392.55 | 539.78 | .3960 | 289,746 |
| 64 | 2632.00 | .8709 | 430.81 | 600.35 | .3960 | 289,746 |
| 65 | 2610.00 | .8709 | 534.81 | 747.43 | .3960 | 289,746 |
| 66 | 2689.00 | .8709 | 307.00 | 310.08 | .1712 | 125,306 |
| 67 | 2657.00 | .8709 | 367.19 | 454.80 | .1712 | 125,306 |
| 68 | 2642.00 | .8709 | 392.55 | 539.78 | .1712 | 125,306 |
| 69 | 2632.00 | .8709 | 430.81 | 600.35 | .1712 | 125,306 |
| 73 | 431.87 | .5916 | 138.00 | 17.05 | .5642 | 412,858 |
| 92 | 2734.00 | .5916 | 140.13 | 29.43 | .4328 | 316,704 |
| 96 | 332.21 | .5916 | 138.39 | 17.05 | .4328 | 316,704 |
| 97 | 431.87 | .5916 | 138.00 | 17.05 | .1314 | 96,154 |
| 100 | 2689.00 | .5916 | 307.00 | 228.13 | .4328 | 316,704 |
| 101 | 2689.00 | .5916 | 307.00 | 228.13 | .3021 | 221,090 |
| 102 | 2657.00 | .5916 | 367.19 | 309.59 | .3021 | 221,090 |
| 103 | 2642.00 | .5916 | 392.55 | 346.29 | .3021 | 221,090 |
| 104 | 2632.00 | .5916 | 430.81 | 409.32 | .3021 | 221,090 |
| 105 | 2610.00 | .5916 | 534.81 | 841.23 | .3021 | 221,090 |
| 106 | 2689.00 | .5916 | 307.00 | 228.13 | .1307 | 95,614 |
| 107 | 2657.00 | .5916 | 367.19 | 309.59 | .1307 | 95,614 |
| 108 | 2642.00 | .5916 | 392.55 | 346.29 | .1307 | 95,614 |
| 109 | 2632.00 | .5916 | 430.81 | 409.32 | .1307 | 95,614 |
| 110 | 2610.00 | .8709 | 534.81 | 747.43 | .1712 | 125,306 |
| 111 | 2610.00 | .5916 | 534.81 | 841.23 | .1307 | 95,614 |
| 114 | 2610.00 | .8709 | 534.81 | 747.43 | .5672 | 415,052 |
| 115 | 2577.00 | .8709 | 674.61 | 912.49 | .5672 | 415,052 |
| 116 | 2610.00 | .5916 | 534.81 | 841.23 | .4328 | 316,704 |
| 117 | 2577.00 | .5916 | 674.61 | 1012.07 | .4328 | 316,704 |
| 118 | 2507.00 | .8709 | 932.18 | 1134.76 | .5672 | 415,052 |
| 119 | 2507.00 | .5916 | 932.18 | 1229.21 | .4328 | 316,704 |

TABLE 2

| Point | P (psiA) | X | T °F. | H(BTU/lb) | G/G30 | Flow lb/hr |
|---|---|---|---|---|---|---|
| 1 | 33.37 | .4872 | 64.00 | −71.94 | 4.0436 | 2,958,901 |
| 2 | 137.48 | .4872 | 64.00 | −71.54 | 4.0436 | 2,958,901 |
| 3 | 122.48 | .4872 | 138.00 | 7.75 | .3818 | 279,420 |
| 4 | 120.48 | .4872 | 175.50 | 170.52 | .3812 | 278,980 |
| 5 | 120.48 | .4872 | 180.50 | 188.77 | 1.9433 | 1,422,027 |
| 6 | 120.48 | .9551 | 180.50 | 634.34 | .4358 | 318,899 |
| 8 | 119.78 | .4872 | 64.06 | −71.54 | .0000 | 0 |
| 9 | 119.78 | .9551 | 86.07 | 456.20 | .4358 | 318,899 |
| 10 | 120.48 | .3520 | 180.50 | 59.96 | 1.5075 | 1,103,129 |
| 11 | 120.08 | .9551 | 142.00 | 561.42 | .4358 | 318,899 |
| 12 | 115.48 | .3520 | 142.00 | 18.80 | 1.5075 | 1,103,129 |
| 13 | 119.78 | .9551 | 86.07 | 456.20 | .4358 | 318,899 |
| 14 | 119.48 | .9551 | 67.13 | 24.47 | .4358 | 318,899 |
| 15 | 120.48 | .4872 | 182.64 | 196.47 | 1.3668 | 1,000,172 |
| 16 | 33.97 | .7500 | 142.00 | 480.57 | 1.0000 | 731,757 |
| 17 | 33.67 | .7500 | 69.67 | 271.56 | 1.0000 | 731,757 |
| 18 | 33.67 | .4872 | 85.17 | 34.04 | 4.0436 | 2,958,901 |
| 19 | 33.67 | .4009 | 88.22 | −44.00 | 3.0436 | 2,227,145 |
| 20 | 33.67 | .4489 | 79.27 | −35.68 | 1.5361 | 1,124,016 |
| 21 | 436.87 | .9551 | 67.13 | 25.96 | .4358 | 318,899 |
| 23 | . | Water | 57.00 | . | 18.5481 | 13,572,689 |
| 24 | . | Water | 80.11 | . | 18.5481 | 13,572,689 |
| 27 | 122.48 | .4872 | 138.00 | 7.75 | 1.3668 | 1,000,172 |
| 28 | 137.48 | .4872 | 64.00 | −71.54 | .5782 | 423,127 |
| 29 | 431.87 | .9551 | 131.00 | 98.53 | .4358 | 318,899 |
| 33 | 122.48 | .4872 | 138.00 | 7.75 | .1952 | 142,875 |
| 34 | 120.48 | .4872 | 175.50 | 170.52 | .1952 | 142,875 |
| 35 | 122.48 | .4872 | 138.00 | 7.75 | .5782 | 423,127 |
| 36 | 122.48 | .4872 | 138.00 | 7.75 | 1.6519 | 1,208,809 |
| 37 | 122.48 | .4872 | 138.00 | 7.75 | .3812 | 278,980 |
| 38 | 34.37 | .7500 | 188.00 | 738.50 | 1.0000 | 731,757 |
| 58 | . | Water | 57.00 | . | 14.4404 | 10,566,883 |
| 59 | . | Water | 70.03 | . | 14.4404 | 10,566,883 |
| 70 | 105.48 | .3520 | 74.00 | −52.46 | 1.5075 | 1,103,129 |
| 71 | 53.37 | .5916 | 84.57 | 63.09 | .5642 | 412,858 |
| 72 | 436.87 | .5916 | 64.00 | −63.64 | .5642 | 412,858 |
| 73 | 431.87 | .5916 | 138.00 | 17.05 | .5642 | 412,858 |
| 74 | 52.37 | .5916 | 64.00 | −65.18 | .5642 | 412,858 |
| 76 | 122.48 | .4872 | 138.00 | 7.75 | 1.6525 | 1,209,248 |
| 77 | 122.48 | .4872 | 138.00 | 7.75 | .3830 | 280,252 |
| 78 | 122.48 | .4872 | 138.00 | 7.75 | 1.2689 | 928,557 |
| 79 | 137.48 | .4872 | 64.00 | −71.54 | 3.5958 | 2,631,275 |
| 82 | 137.48 | .4872 | 64.00 | −71.54 | .3818 | 279,420 |

TABLE 2-continued

| Point | P (psiA) | X | T °F. | H(BTU/lb) | G/G30 | Flow lb/hr |
|---|---|---|---|---|---|---|
| 83 | 137.48 | .4872 | 64.00 | −71.54 | 2.6358 | 1,928,729 |
| 84 | 122.48 | .4872 | 138.00 | 7.75 | 2.6358 | 1,928,729 |
| 85 | 53.37 | .4872 | 98.51 | 7.75 | 1.6525 | 1,209,248 |
| 86 | 53.37 | .9929 | 98.51 | 580.59 | .1165 | 85,232 |
| 87 | 53.37 | .4489 | 98.51 | −35.68 | 1.5361 | 1,124,016 |
| 89 | 137.48 | .4872 | 64.00 | −71.54 | .4477 | 327,626 |
| 90 | 53.37 | .4872 | 64.30 | −71.54 | .4477 | 327,626 |
| 91 | 33.67 | .3520 | 74.25 | −52.46 | 1.5075 | 1,103,129 |
| 98 | . | Water | 57.00 | . | 3.2612 | 2,386,375 |
| 99 | . | Water | 79.19 | . | 3.2612 | 2,386,375 |

TABLE 3

Performance Summary of the Proposed FIG. 1 System When Using the FIG. 2 Condensation Subsystem and the Parameters of Tables 1 and 2

| | |
|---|---|
| Pumps 207 and 208 | = 3026.98 kWe |
| Pump 231 | = 173.55 kWe |
| Pump 233 | = 431.50 kWe |
| Pump 232 | = 233.23 kWe |
| Sum of Cycle Pumps | = 3865.27 kWe |
| Water Pumps | = 623.97 kWe |
| Total Pump Work | = 4489.24 kWe |

SYSTEM OUTPUT

| | | |
|---|---|---|
| Gas turbine output | 142170.00 | kWe |
| Bottoming cycle turbine power | 96935.39 | kWe |
| Bottoming cycle turbine shaft power | 96751.22 | kWe |
| Bottoming cycle turbine electrical power | 95106.44 | kWe |
| Bottoming cycle output | 90617.21 | kWe |
| System total output | 232787.21 | kWe |
| Fuel consumption (mil) | 1467.00 | M BTU/hr |
| Overall system efficiency | 54.14% | |
| System gross efficiency | 55.19% | |
| Bottoming cycle gross efficiency | 39.99% | |
| Gross utilization efficiency | 39.19% | |
| Bottoming cycle efficiency | 37.39% | |
| Utilized energy of exhaust gas | 112739.15 | kWe |
| Bottoming cycle Second Law efficiency | 80.38% | |
| Available exergy of exhaust gas | 113510.35 | kWe |
| Bottoming cycle exergy utilization efficiency | 79.83% | |
| Exergy utilization ratio | 99.32% | |
| Heat rate net | 6301.89 | BTU/kWhe |

The system of the present invention should provide for an increased thermal efficiency when compared to the system described in U.S. Pat. No. 4,604,867. If the system of the present invention is used as a bottoming cycle for a combined cycle system, such as one that includes an Asea Brown Boveri gas turbine 13E, the system of the present invention should theoretically deliver about 90.617 MW net power output; whereas, the system described in U.S. Pat. No. 4,604,867 theoretically should deliver about 88.279 MW net power output. Thus, the system of the present invention, when used in such a combined cycle system, theoretically should provide approximately a 2.6% increase in efficiency over the system described in U.S. Pat. No. 4,604,867. Because the system of the present invention should not present any significant additional technological complications, it should likewise provide improved economics when compared to the system described in U.S. Pat. No. 4,604,867.

While the present invention has been described with respect to a preferred embodiment, those skilled in the art will appreciate a number of variations and modifications of that embodiment. For example, multi-component working streams other than ammonia-water mixtures may be used, the number and types of heat exchangers may be increased or decreased, the number and types of pumps, turbines, condensers, separators, boilers, recoolers, pressure reduction apparatus, etc., may be varied, as well as the number and composition of the streams flowing through the system and the particular uses for those streams. Thus, it is intended that the appended claims cover all such variations and modifications as fall within the true spirit and scope of the present invention.

What is claimed is:

1. A method for implementing a thermodynamic cycle comprising the steps of:

expanding a high pressure gaseous working stream transforming its energy into usable form and generating a spent stream;

condensing the spent stream producing a condensed stream;

generating from the condensed stream a rich stream, having a higher percentage of a low boiling component than is included in the condensed stream, and a lean stream, having a lower percentage of a low boiling component than is included in the condensed stream;

passing the rich stream and the lean stream through a boiler, generating an evaporated rich stream and an evaporated lean stream; and combining the evaporated rich stream with the evaporated lean stream, after the two evaporated streams exit from the boiler, generating the high pressure gaseous working stream.

2. The method of claim 1 further comprising the steps of:

separating the rich stream into first and second rich substreams;

separating the lean stream into first and second lean substreams;

passing the first rich substream and the first lean substream through the boiler, where heat transferred from an external source at least partially evaporates those two streams;

passing the second rich substream and the second lean substream through a recooler where heat transferred from the spent stream at least partially evaporates those two streams; and combining the first rich substream with the second rich substream, reconstituting the rich stream, and combining the first lean substream with the second lean substream, reconstituting the lean stream, prior to combining the rich stream with the lean stream generating the high pressure gaseous working stream.

3. The method of claim 1 wherein the spent stream comprises an intermediate pressure gaseous stream, a low pressure gaseous stream, and a low pressure spent stream and wherein the method further comprises the steps of:

expanding the high pressure gaseous working stream producing the intermediate pressure gaseous stream;

reheating the intermediate pressure gaseous stream;

expanding the reheated intermediate pressure gaseous stream producing the low pressure gaseous stream; and expanding the low pressure gaseous stream producing the low pressure spent stream.

4. The method of claim 1 further comprising the steps of:

generating the rich stream and the lean stream by first forming from the condensed stream a first partially evaporated stream and a second partially evaporated stream;

separating the first partially evaporated stream into a first vapor stream and a first liquid stream;

separating the second partially evaporated stream into a second vapor stream and a second liquid stream;

generating the rich stream from the first vapor stream; and combining the second vapor stream with a mixing stream generating the lean stream.

5. The method of claim 4 further comprising forming the mixing stream from the condensed stream.

6. The method of claim 4 further comprising the steps of:

separating the condensed stream into a first condensed substream and a second condensed substream;

separating the first condensed substream into a first mixing stream and a second mixing stream;

separating the second condensed substream into third, fourth and fifth condensed substreams;

heating the third condensed substream with heat transferred from the first vapor stream producing a first preheated substream;

heating the fourth condensed substream with heat transferred from the first liquid stream producing a second preheated substream;

heating the fifth condensed substream with heat transferred from the spent stream producing a third preheated substream;

combining the first, second and third preheated substreams forming a preheated stream;

separating the preheated stream into first, second, third and fourth pre-partially evaporated substreams;

partially evaporating the first pre-partially evaporated substream with heat transferred from the first vapor stream producing a first partially evaporated substreams;

partially evaporating the second pre-partially evaporated substream with heat transferred from the first liquid stream producing a second partially evaporated substream;

partially evaporating the third pre-partially evaporated substream with heat transferred from the spent stream producing a third partially evaporated substream;

combining the first, second and third partially evaporated substreams generating the first partially evaporated stream;

reducing the pressure of the fourth pre-partially evaporated substream generating the second partially evaporated stream;

combining the first liquid stream with the second liquid stream producing a third mixing stream;

combining the first mixing stream with the first vapor stream generating the rich stream;

combining the second vapor stream with the second mixing stream generating the lean stream;

combining the third mixing stream with the spent stream forming a pre-condensed stream; and condensing the pre-condensed stream generating the condensed stream.

7. A method for implementing a thermodynamic cycle comprising the steps of:

expanding a high pressure gaseous working stream transforming its energy into usable form and generating a spent stream;

condensing the spent stream producing a condensed stream;

forming from the condensed stream a first partially evaporated stream and a second partially evaporated stream;

separating the first partially evaporated stream into a first vapor stream and a first liquid stream;

separating the second partially evaporated stream into a second vapor stream and a second liquid stream;

forming from the first vapor stream a rich stream, having a higher percentage of a low boiling component than is included in the condensed stream;

combining the second vapor stream with a mixing stream generating a lean stream, having a lower percentage of a low boiling component than is included in the condensed stream; and combining the rich stream and the lean stream forming the high pressure gaseous working stream.

8. The method of claim 7 further comprising the steps of:

preheating the rich stream and the lean stream producing a preheated rich stream and a preheated lean stream;

combining the preheated rich stream with the preheated lean stream producing a preheated stream; and evaporating the preheated stream producing the high pressure gaseous working stream.

9. The method of claim 7 further comprising the steps of:

preheating and partially evaporating the rich stream and the lean stream producing a partially evaporated rich stream and a partially evaporated lean stream;

combining the partially evaporated rich stream with the partially evaporated lean stream forming a partially evaporated stream; and evaporating the partially evaporated stream producing the high pressure gaseous working stream.

10. The method of claim 7 further comprising the steps of:

preheating and evaporating the rich stream and the lean stream producing an evaporated rich stream and an evaporated lean stream;

combining the evaporated rich stream with the evaporated lean stream forming an evaporated stream; and superheating the evaporated stream producing the high pressure gaseous working stream.

11. The method of claim 7 further comprising forming the mixing stream from the condensed stream.

12. The method of claim 7 further comprising heating the rich stream and the lean stream with heat transferred from the first liquid stream prior to combining the rich stream and the lean stream forming the high pressure gaseous working stream.

13. A method for implementing a thermodynamic cycle comprising the steps of:

expanding a high pressure gaseous working stream transforming its energy into usable form and generating a spent stream;

combining the spent stream with a third mixing stream producing a pre-condensed stream;

condensing the pre-condensed stream producing a condensed stream;

separating the condensed stream into a first condensed substream and a second condensed substream;

separating the first condensed substream into a first mixing stream and a second mixing stream;

separating the second condensed substream into third, fourth and fifth condensed substreams;

heating the third condensed substream with heat transferred from a first vapor stream producing a first preheated substream;

heating the fourth condensed substream with heat transferred from a first liquid stream producing a second preheated substream;

heating the fifth condensed substream with heat transferred from the spent stream producing a third preheated substream;

combining the first, second and third preheated substreams forming a preheated stream;

separating the preheated stream into first, second, third and fourth pre-partially evaporated substreams;

partially evaporating the first pre-partially evaporated substream with heat transferred from the first vapor stream producing a first partially evaporated substream;

partially evaporating the second pre-partially evaporated substream with heat transferred from the first liquid stream producing a second partially evaporated substream;

partially evaporating the third pre-partially evaporated substream with heat transferred from the spent stream producing a third partially evaporated substream;

combining the first, second and third partially evaporated substreams generating a first partially evaporated stream;

reducing the pressure of the fourth pre-partially evaporated substream generating a second partially evaporated stream;

separating the first partially evaporated stream into the first vapor stream and the first liquid stream;

separating the second partially evaporated stream into a second vapor stream and a second liquid stream;

combining the first liquid stream, after it has transferred heat to the second pre-partially evaporated substream and the fourth condensed substream, with the second liquid stream producing the third mixing stream;

combining the first vapor stream with the first mixing stream generating a rich stream, having a higher percentage of a low boiling component than is included in the condensed stream;

combining the second vapor stream with the second mixing stream generating a lean stream, having a lower percentage of a low boiling component than is included in the condensed stream; and combining the rich stream and the lean stream forming the high pressure gaseous working stream.

14. A method for implementing a thermodynamic cycle comprising the steps of:

expanding a high pressure gaseous working stream transforming its energy into usable form and generating an intermediate pressure gaseous stream;

reheating the intermediate pressure gaseous stream;

expanding the reheated intermediate pressure gaseous stream producing a low pressure gaseous stream;

expanding the low pressure gaseous stream producing a low pressure spent stream;

combining the low pressure spent stream with a third mixing stream producing a pre-condensed stream;

condensing the pre-condensed stream producing a condensed stream;

separating the condensed stream into a first condensed substream and a second condensed substream;

separating the first condensed substream into a first mixing stream and a second mixing stream;

separating the second condensed substream into third, fourth and fifth condensed substreams;

heating the third condensed substream with heat transferred from a first vapor stream producing a first preheated substream;

heating the fourth condensed substream with heat transferred from a first liquid stream producing a second preheated substream;

heating the fifth condensed substream with heat transferred from the low pressure spent stream producing a third preheated substream;

combining the first, second and third preheated substreams forming a preheated stream;

separating the preheated stream into first, second, third and fourth pre-partially evaporated substreams;

partially evaporating the first pre-partially evaporated substream with heat transferred from the first vapor stream producing a first partially evaporated substream;

partially evaporating the second pre-partially evaporated substream with heat transferred from the first liquid stream producing a second partially evaporated substream;

partially evaporating the third pre-partially evaporated substream with heat transferred from the low pressure spent stream producing a third partially evaporated substream;

combining the first, second and third partially evaporated substreams generating a first partially evaporated stream;

reducing the pressure of the fourth pre-partially evaporated substream generating a second partially evaporated stream;

separating the first partially evaporated stream into the first vapor stream and the first liquid stream;

separating the second partially evaporated stream into a second vapor stream and a second liquid stream;

combining the first vapor stream with the first mixing stream generating a rich stream, having a higher percentage of a low boiling component than is included in the condensed stream;

combining the second vapor stream with the second mixing stream generating a lean stream, having a lower percentage of a low boiling component than is included in the condensed stream;

combining the first liquid stream with the second liquid stream producing the third mixing stream;

separating the rich stream into first and second rich substreams;

separating the lean stream into first and second lean substreams;

passing the first rich substream and the first lean substream through a boiler, where heat transferred from an external source at least partially evaporates those two streams;

passing the second rich substream and the second lean substream through a recooler, where heat transferred from the low pressure gaseous stream at least partially evaporates those two streams;

combining the first rich substream with the second rich substream, reconstituting the rich stream, and combining the first lean substream with the second lean substream, reconstituting the lean stream; and combining the rich stream with the lean stream generating the high pressure gaseous working stream.

15. A system for implementing a thermodynamic cycle comprising:

means for expanding a high pressure gaseous working stream transforming its energy into usable form and generating a spent stream;

a condenser for condensing the spent stream producing a condensed stream;

a rich stream, having a higher percentage of a low boiling component than is included in the condensed stream, that is generated from the condensed stream;

a lean stream, having a lower percentage of a low boiling component than is included in the condensed stream, that is generated from the condensed stream;

a boiler through which pass the rich stream and the lean stream, generating an evaporated rich stream and an evaporated lean stream; and a first stream mixer for combining the evaporated rich stream with the evaporated lean stream, after the two evaporated streams exit from the boiler, generating the high pressure gaseous working stream.

16. The system of claim 15 further comprising:

a second stream mixer for separating the rich stream into first and second rich substreams;

a third stream mixer for separating the lean stream into first and second lean substreams;

means for passing the first rich substream and the first lean substream through the boiler;

an external heat source for transferring heat to the first rich substream and the first lean substream at least partially evaporating those two substreams;

a recooler through which pass the second rich substream and the second lean substream, and where heat transferred from the spent stream at least partially evaporates those two substreams; and a third stream mixer for combining the first rich substream with the second rich substream, reconstituting the rich stream, and a fourth stream mixer for combining the first lean substream with the second lean substream, reconstituting the lean stream, prior to the first stream mixer's combining of the rich stream with the lean stream generating the high pressure gaseous working stream.

17. The system of claim 15 wherein the spent stream comprises an intermediate pressure gaseous stream, a low pressure gaseous stream, and a low pressure spent stream and wherein the system further comprises:

means for expanding the high pressure gaseous working stream producing the intermediate pressure gaseous stream;

means for reheating the intermediate pressure gaseous stream;

means for expanding the reheated intermediate pressure gaseous stream producing the low pressure gaseous stream; and means for expanding the low pressure gaseous stream producing the low pressure spent stream.

18. The system of claim 15 further comprising:

means for forming from the condensed stream a first partially evaporated stream and a second partially evaporated stream;

a first separator for separating the first partially evaporated stream into a first vapor stream and a first liquid stream;

a second separator for separating the second partially evaporated stream into a second vapor stream and a second liquid stream;

means for generating the rich stream from the first vapor stream; and a second stream mixer for combining the second vapor stream with a mixing stream generating the lean stream.

19. The system of claim 18 further comprising a stream separator for forming the mixing stream from the condensed stream.

20. The system of claim 18 further comprising:

a first stream separator for separating the condensed stream into a first condensed substream and a second condensed substream;

a second stream separator for separating the first condensed substream into a first mixing stream and a second mixing stream;

a third stream separator for separating the second condensed substream into third, fourth and fifth condensed substreams;

a first heat exchanger for heating the third condensed substream with heat transferred from the first vapor stream producing a first preheated substream;

a second heat exchanger for heating the fourth condensed substream with heat transferred from the first liquid stream producing a second preheated substream;

a third heat exchanger for heating the fifth condensed substream with heat transferred from the spent stream producing a third preheated substream;

a third stream mixer for combining the first, second and third preheated substreams forming a preheated stream;

a fourth stream separator for separating the preheated stream into first, second, third and fourth pre-partially evaporated substreams;

a fourth heat exchanger for partially evaporating the first pre-partially evaporated substream with heat transferred from the first vapor stream producing a first partially evaporated substream;

a fifth heat exchanger for partially evaporating the second pre-partially evaporated substream with heat transferred from the first liquid stream producing a second partially evaporated substream;

a sixth heat exchanger for partially evaporating the third pre-partially evaporated substream with heat transferred from the spent stream producing a third partially evaporated substream;

a fourth stream mixer for combining the first, second and third partially evaporated substreams generating the first partially evaporated stream;

a pressure reduction device for reducing the pressure of the fourth pre-partially evaporated substream generating the second partially evaporated stream;

a fifth stream mixer for combining the first liquid stream with the second liquid stream producing a third mixing stream;

a sixth stream mixer for combining the first mixing stream with the first vapor stream generating the rich stream;

the second stream mixer combining the second vapor stream with the second mixing stream generating the lean stream;

a seventh stream mixer for combining the third mixing stream with the spent stream forming a pre-condensed stream; and the condenser for condensing the pre-condensed stream generating the condensed stream.

21. A system for implementing a thermodynamic cycle comprising:

means for expanding a high pressure gaseous working stream transforming its energy into usable form and generating a spent stream;

a condenser for condensing the spent stream producing a condensed stream;

means for forming from the condensed stream a first partially evaporated stream and a second partially evaporated stream;

a first separator for separating the first partially evaporated stream into a first vapor stream and a first liquid stream;

a second separator for separating the second partially evaporated stream into a second vapor stream and a second liquid stream;

means for forming from the first vapor stream a rich stream, having a higher percentage of a low boiling component than is included in the condensed stream;

a first stream mixer for combining the second vapor stream with a mixing stream generating a lean stream, having a lower percentage of a low boiling component than is included in the condensed stream; and a second stream mixer for combining the rich stream and the lean stream forming the high pressure gaseous working stream.

22. The system of claim 21 further comprising:

a first heat exchanger for preheating the rich stream and the lean stream producing a preheated rich stream and a preheated lean stream;

the second stream mixer combining the preheated rich stream with the preheated lean stream producing a preheated stream; and a second heat exchanger for evaporating the preheated stream producing the high pressure gaseous working stream.

23. The system of claim 21 further comprising:

a first heat exchanger for preheating and partially evaporating the rich stream and the lean stream producing a partially evaporated rich stream and a partially evaporated lean stream;

the second stream mixer combining the partially evaporated rich stream with the partially evaporated lean stream forming a partially evaporated stream; and a second heat exchanger for evaporating the partially evaporated stream producing the high pressure gaseous working stream.

24. The system of claim 21 further comprising:

a first heat exchanger for preheating and evaporating the rich stream and the lean stream producing an evaporated rich stream and an evaporated lean stream;

the second stream mixer combining the evaporated rich stream with the evaporated lean stream forming an evaporated stream; and a second heat exchanger for superheating the evaporated stream producing the high pressure gaseous working stream.

25. The system of claim 21 further comprising a stream separator for forming the mixing stream from the condensed stream.

26. The system of claim 21 further comprising a heat exchanger for heating the rich stream and the lean stream with heat transferred from the first liquid stream prior to the second stream mixer combining the rich stream and the lean stream forming the high pressure gaseous working stream.

27. A system for implementing a thermodynamic cycle comprising:

means for expanding a high pressure gaseous working stream transforming its energy into usable form and generating a spent stream;

a first stream mixer for combining the spent stream with a third mixing stream producing a pre-condensed stream;

a condenser for condensing the pre-condensed stream producing a condensed stream;

a first stream separator for separating the condensed stream into a first condensed substream and a second condensed substream;

a second stream separator for separating the first condensed substream into a first mixing stream and a second mixing stream;

a third stream separator for separating the second condensed substream into third, fourth and fifth condensed substreams;

a first heat exchanger for heating the third condensed substream with heat transferred from a first vapor stream producing a first preheated substream;

a second heat exchanger for heating the fourth condensed substream with heat transferred from a first liquid stream producing a second preheated substream;

a third heat exchanger for heating the fifth condensed substream with heat transferred from the spent stream producing a third preheated substream;

a second stream mixer for combining the first, second and third preheated substreams forming a preheated stream;

a fourth stream separator for separating the preheated stream into first, second, third and fourth pre-partially evaporated substreams;

a fourth heat exchanger for partially evaporating the first pre-partially evaporated substream with heat transferred from the first vapor stream producing a first partially evaporated substream;

a fifth heat exchanger for partially evaporating the second pre-partially evaporated substream with heat transferred from the first liquid stream producing a second partially evaporated substream;

a sixth heat exchanger for partially evaporating the third pre-partially evaporated substream with heat transferred from the spent stream producing a third partially evaporated substream;

a third stream mixer for combining the first, second and third partially evaporated substreams generating a first partially evaporated stream;

a pressure reduction device for reducing the pressure of the fourth pre-partially evaporated substream generating a second partially evaporated stream;

a first separator for separating the first partially evaporated stream into the first vapor stream and the first liquid stream;

a second separator for separating the second partially evaporated stream into a second vapor stream and a second liquid stream;

a fourth stream mixer for combining the first liquid stream, after it has transferred heat to the second pre-partially evaporated substream and the fourth condensed substream, with the second liquid stream producing the third mixing stream;

a fifth stream mixer for combining the first vapor stream with the first mixing stream generating a rich stream, having a higher percentage of a low boiling component than is included in the condensed stream;

a sixth stream mixer for combining the second vapor stream with the second mixing stream generating a lean stream, having a lower percentage of a low boiling component than is included in the condensed stream; and a seventh stream mixer for combining the rich stream and the lean stream forming the high pressure gaseous working stream.

28. A system for implementing a thermodynamic cycle comprising:

means for expanding a high pressure gaseous working stream transforming its energy into usable form and generating an intermediate pressure gaseous stream;

means for reheating the intermediate pressure gaseous stream;

means for expanding the reheated intermediate pressure gaseous stream producing a low pressure gaseous stream;

means for expanding the low pressure gaseous stream producing a low pressure spent stream;

a first stream mixer for combining the low pressure spent stream with a third mixing stream producing a pre-condensed stream;

a condenser for condensing the pre-condensed stream producing a condensed stream;

a first stream separator for separating the condensed stream into a first condensed substream and a second condensed substream;

a second stream separator for separating the first condensed substream into a first mixing stream and a second mixing stream;

a third stream separator for separating the second condensed substream into third, fourth and fifth condensed substreams;

a first heat exchanger for heating the third condensed substream with heat transferred from a first vapor stream producing a first preheated substream;

a second heat exchanger for heating the fourth condensed substream with heat transferred from a first liquid stream producing a second preheated substream;

a third heat exchanger for heating the fifth condensed substream with heat transferred from the low pressure spent stream producing a third preheated substream;

a second stream mixer for combining the first, second and third preheated substreams forming a preheated stream;

a fourth stream separator for separating the preheated stream into first, second, third and fourth pre-partially evaporated substreams;

a fourth heat exchanger for partially evaporating the first pre-partially evaporated substream with heat transferred from the first vapor stream producing a first partially evaporated substream;

a fifth heat exchanger for partially evaporating the second pre-partially evaporated substream with heat transferred from the first liquid stream producing a second partially evaporated substream;

a sixth heat exchanger for partially evaporating the third pre-partially evaporated substream with heat transferred from the low pressure spent stream producing a third partially evaporated substream;

a third stream mixer for combining the first, second and third partially evaporated substreams generating a first partially evaporated stream;

a pressure reduction device for reducing the pressure of the fourth pre-partially evaporated substream generating a second partially evaporated stream;

a first separator for separating the first partially evaporated stream into the first vapor stream and the first liquid stream;

a second separator for separating the second partially evaporated stream into a second vapor stream and a second liquid stream;

a fourth stream mixer for combining the first vapor stream with the first mixing stream generating a rich stream, having a higher percentage of a low boiling component than is included in the condensed stream;

a fifth stream mixer for combining the second vapor stream with the second mixing stream generating a lean stream, having a lower percentage of a low boiling component than is included in the condensed stream;

a sixth stream mixer for combining the first liquid stream with the second liquid stream producing the third mixing stream;

a fifth stream separator for separating the rich stream into first and second rich substreams;

a sixth stream separator for separating the lean stream into first and second lean substreams;

a boiler through which pass the first rich substream and the first lean substream;

an external heat source for transferring heat to the first rich substream and the first lean substream at least partially evaporating those two substreams;

a recooler through which pass the second rich substream and the second lean substream, where heat transferred from the low pressure gaseous stream at least partially evaporates those two substreams;

a seventh stream mixer for combining the first rich substream with the second rich substream, reconstituting the rich stream;

an eighth stream mixer for combining the first lean substream with the second lean substream, reconstituting the lean stream; and a ninth stream mixer for combining the rich stream with the lean stream generating the high pressure gaseous working stream.

* * * * *